US010794134B2

(12) United States Patent
Hoeink et al.

(10) Patent No.: US 10,794,134 B2
(45) Date of Patent: Oct. 6, 2020

(54) ESTIMATION OF OPTIMUM TRIPPING SCHEDULES

(71) Applicants: Tobias Hoeink, Houston, TX (US); Wouter E. Van Der Zee, Voorburg (NL)

(72) Inventors: Tobias Hoeink, Houston, TX (US); Wouter E. Van Der Zee, Voorburg (NL)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 994 days.

(21) Appl. No.: 15/228,220

(22) Filed: Aug. 4, 2016

(65) Prior Publication Data

US 2018/0039900 A1 Feb. 8, 2018

(51) Int. Cl.
*E21B 25/00* (2006.01)

(52) U.S. Cl.
CPC ..... *E21B 25/005* (2013.01)

(58) Field of Classification Search
CPC ..... E21B 21/08; E21B 25/005; G06F 17/5009
USPC ..... 703/10
See application file for complete search history.

(56) References Cited

U.S. PATENT DOCUMENTS 4,996,421 A * 2/1991 Rai ..... G01N 21/3563 250/253
5,687,138 A * 11/1997 Kimball ..... G01V 1/50 367/31
7,548,873 B2 * 6/2009 Veeningen ..... G06Q 10/06 705/7.12
8,892,407 B2 * 11/2014 Budinnan ..... E21B 47/04 703/10
2003/0168257 A1 * 9/2003 Aldred ..... E21B 49/003 175/24
2005/0267719 A1 * 12/2005 Foucault ..... E21B 44/00 703/10

(Continued)

OTHER PUBLICATIONS

Alexei V. Milkov ("Risk tables for less biased and more consistent estimation of probability of geological success (PoS) for segments with conventional oil and gas prospective resources", Elsevier B.V., 2015, pp. 453-476 (Year: 2015).*

(Continued)

*Primary Examiner* — Iftekhar A Khan
(74) *Attorney, Agent, or Firm* — Cantor Colburn LLP

(57) ABSTRACT

An embodiment of a method for evaluating a schedule for removing a core sample includes generating a model of the core by applying a value of each of the input parameters, one or more of the input parameter values associated with an uncertainty range, and defining a proposed tripping schedule, and performing an evaluation including applying the proposed tripping schedule and a set of expected input parameter values to the model, estimating a core parameter and determining whether the tripping schedule is predicted to be successful by comparing the core parameter to selected core damage criteria. The method also includes iteratively repeating the evaluation, each evaluation being performed using a different combination of input parameter values than any other evaluation, and calculating a probability of success (POS) of the proposed tripping schedule based on a number of evaluations that result in the tripping schedule being predicted to be successful.

18 Claims, 7 Drawing Sheets

(56) References Cited

U.S. PATENT DOCUMENTS

2006/0273788 A1* 12/2006 Georgi ..... G01N 24/081 324/303
2007/0199721 A1* 8/2007 Givens ..... G06Q 10/06 166/382
2009/0152005 A1* 6/2009 Chapman ..... E21B 7/00 175/24
2010/0084191 A1* 4/2010 Chapman ..... E21B 44/00 175/24
2010/0191516 A1* 7/2010 Benish ..... E21B 43/00 703/10
2010/0259415 A1* 10/2010 Strachan ..... E21B 44/00 340/853.6
2011/0054869 A1* 3/2011 Li ..... G06T 17/05 703/10
2011/0172976 A1* 7/2011 Budiman ..... E21B 47/022 703/2
2011/0174543 A1* 7/2011 Walkingshaw ..... E21B 49/06 175/58
2012/0274664 A1* 11/2012 Fagnou ..... G06F 3/04855 345/660
2013/0110483 A1* 5/2013 Chugunov ..... G01V 99/005 703/10
2013/0140031 A1* 6/2013 Cohen ..... E21B 43/26 166/308.1
2013/0292178 A1* 11/2013 Burress ..... E21B 7/00 175/50
2013/0346040 A1* 12/2013 Morales German .... G06F 30/20 703/2
2014/0116776 A1* 5/2014 Marx ..... E21B 44/00 175/24
2014/0278110 A1* 9/2014 Chugunov ..... G01V 11/00 702/6
2014/0278318 A1* 9/2014 Kauerauf ..... G01V 99/005 703/10
2014/0320126 A1* 10/2014 Heaton ..... G01V 11/00 324/303
2014/0345945 A1* 11/2014 Hoeink ..... E21B 49/02 175/50
2015/0006082 A1* 1/2015 Zhang ..... G01V 1/306 702/11
2015/0184508 A1* 7/2015 Huang ..... E21B 7/061 703/6
2016/0053603 A1* 2/2016 Israel ..... E21B 44/00 702/6
2016/0097270 A1* 4/2016 Pobedinski ..... E21B 44/00 700/275
2016/0326845 A1* 11/2016 Djikpesse ..... E21B 43/00

OTHER PUBLICATIONS

John C. Davis ("Estimation of the Probability of Success in Petroleum Exploration", Mathematical Geology, 1977, pp. 409-427) (Year : 1977).*
Peel et al. (A practical guide to the use of success versus failure statistics in the estimation of prospect risk,2009, EDA publishing) Year: 2009).*
John C. Davis ("Estimation of the Probability of Success in Petroleum Exploration", Mathematical Geology, vol. 9, No. 4, 1977, pp. 409-427) (Year: 1977).*
Chen Bao ("Verification for Chance of Geologic Success", Norwegian University of Science and Technology, 2016, pp. 1-67) (Year: 2016).*
Alexei V. Milkov ("Risk tables for less biased and more consistent estimation of probability of geological success (PoS) for segments with conventional oil and gas prospective resources", Earth-Science Reviews 150 (2015) 453-476) (Year: 2015).*
M. Byrne Zubizarreta, "Pore Pressure Evolution and Core Damage: A Computational Fluid Dynamics Approach", SCA2011-41, This paper was prepared for presentation at the International Symposium of the Societ of Core Analystes held in Austin, Texas, USA Sep. 18-21; 2011; 6 pages.
M.H.H. Hettema, "Minimizing Coring-Induced Damage in Consolidated Rock", SPE/ISRM 78156, This paper was prepared for presentation at the SPE/ISRM Rock Mechanics Conference held in Irving , TX Oct. 20-23, 2002, 12 pages.
Notification of Transmittal of the International Search Report and the Written Opinion of the International Searching Authority, or the Declaration; PCT/US2014/039069; dated Sep. 23, 2014, 10 pages.

* cited by examiner

ESTIMATION OF OPTIMUM TRIPPING SCHEDULES

BACKGROUND

In hydrocarbon exploration and energy industries, estimation of subterranean hydrocarbon reservoirs is accomplished using various techniques for measuring formation properties. Some techniques involve coring, in which rock cores from a formation are taken by drilling into a formation using a drill string that includes a core bit. During a coring operation, a rock core in the drill string is retrieved by retrieving the core via the drill string or wireline, which is referred to as "tripping." During tripping, damage to the core can occur due to decompression in the borehole, which can change various properties of the rock in the core and thus compromise results of analysis of the core at the surface. Tripping schedules should be planned that minimize core damage while allowing retrieval of the core within an acceptable time frame.

SUMMARY

An embodiment of a method for evaluating a schedule for removing a core sample from a borehole includes taking the core sample within the borehole with a sampling tool, generating a model of the core sample based on a plurality of input parameters, the generating including applying a value of each of the input parameters, wherein one or more of the input parameter values is associated with an uncertainty range, and defining a proposed tripping schedule, and performing, by a processor, an evaluation of the proposed tripping schedule, the evaluation including applying the proposed tripping schedule and a set of expected input parameter values to the model, estimating a core parameter and determining whether the tripping schedule is predicted to be successful by comparing the core parameter to selected core damage criteria. The method also includes iteratively repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a value of the at least one parameter in a previous evaluation and within the uncertainty associated with the at least one parameter, each evaluation being performed using a different combination of input parameter values than any other evaluation, calculating a probability of success (POS) of the proposed tripping schedule based on a number of evaluations that result in the tripping schedule being predicted to be successful, and selecting the proposed tripping schedule based on the POS having an acceptable value.

An embodiment of a system for evaluating a schedule for removing a core sample from a borehole includes a carrier configured to transport the core sample through at least part of the borehole, and a processor configured to evaluate a tripping schedule for removing the core sample. The processor is configured to perform generating a model of the core sample based on a plurality of input parameters, the generating including applying a value of each of the input parameters, wherein one or more of the input parameter values is associated with an uncertainty range, defining a proposed tripping schedule, performing an evaluation of the proposed tripping schedule, the evaluation including applying the proposed tripping schedule and a set of expected input parameter values to the model, and estimating a core parameter and determining whether the tripping schedule is predicted to be successful by comparing the core parameter to selected core damage criteria. The processor is also configured to perform repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a value of the at least one parameter in a previous evaluation and within the uncertainty associated with the at least one parameter, each evaluation being performed using a different combination of input parameter values than any other evaluation, and calculating a probability of success (POS) of the proposed tripping schedule based on a number of evaluations that result in the tripping schedule being predicted to be successful.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
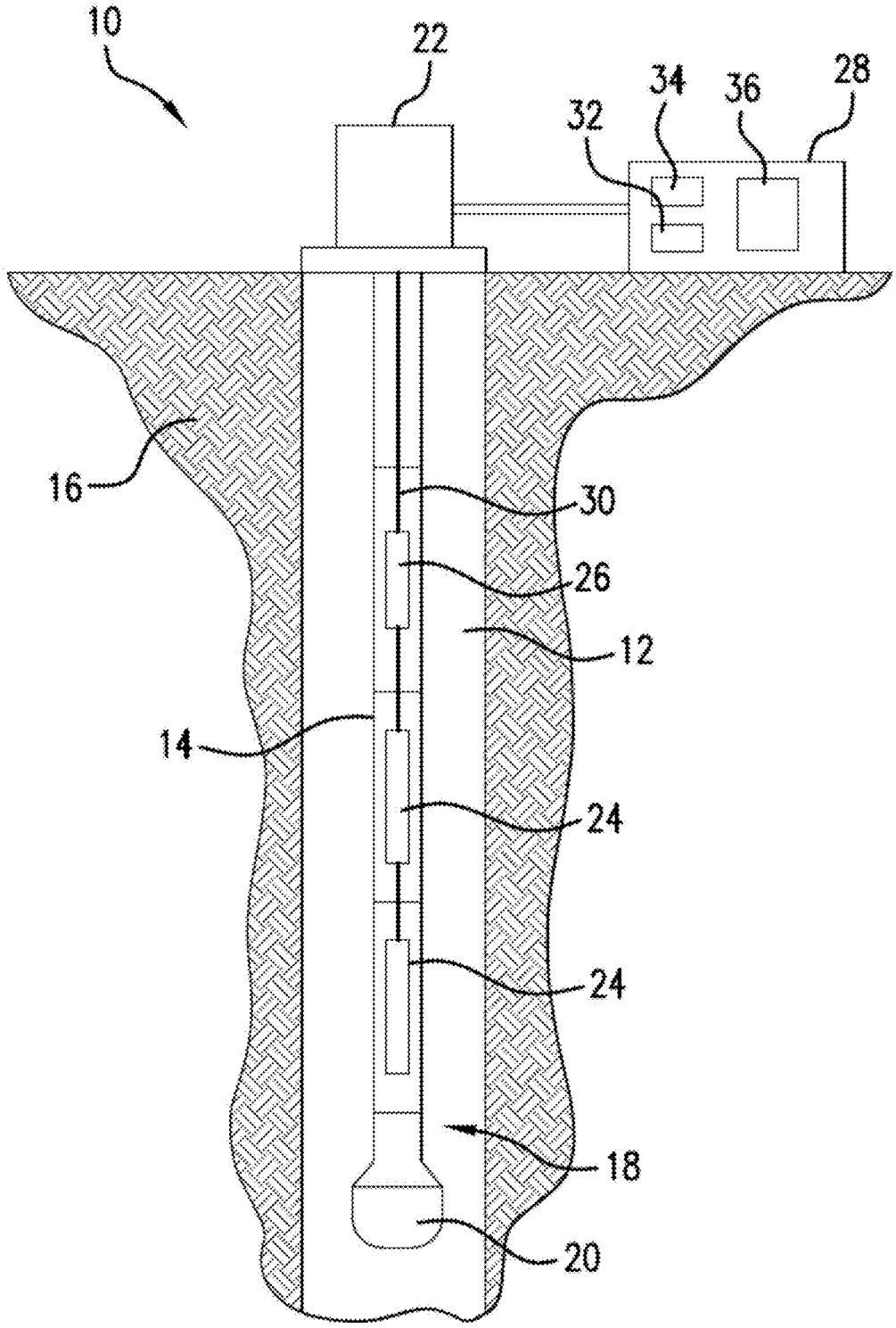
FIG. 1 is a side cross-sectional view of an embodiment of a drilling and/or geosteering system.

The systems and methods described herein provide for modeling of downhole parameters such as pore pressure to predict or estimate an optimum or suitable tripping schedule that minimizes core damage from decompression while tripping a formation core sample out of a borehole within a selected time period. An embodiment of a method includes constructing a mathematical model of a formation core sample based on geometric properties of the core and core material properties such as permeability and fluid characteristics. Tripping schedules may be simulated by inputting various parameters (e.g., formation properties, fluid properties, etc.) and a selected tripping schedule to the model to generate predicted or output parameter values or curves that can be associated with potential core damage. One or more predicted or output parameters are compared to core damage criteria to determine whether the selected tripping schedule is acceptable.

For example, maximum pore pressure differences within the core are calculated at various depths and/or times based on the model for each proposed tripping schedule. The maximum pore pressure differences are compared to core damage criteria that includes pore pressure difference criteria associated with the tensile rock strength of the core material to predict core damage due to gas expansion or decompression. A tripping schedule is identified and/or calculated that satisfies the core damage criteria, e.g., that results in a maximum pore pressure difference that is less than or equal to a selected threshold.

The method may include iteratively applying multiple proposed tripping schedules to the model. A "suitable" tripping schedule is calculated by selecting one of the applied tripping schedules or iteratively adjusting one or more proposed tripping schedules until a tripping schedule having acceptable time and core damage criteria is found.

In one embodiment, a tripping schedule is evaluated based on input parameters and uncertainties that may be associated with one or multiple parameters. An input parameter may have an expected value, derived from measurements or other information. However, many such values may have uncertainties due to, e.g., uncertainties in sensor calibrations.

The systems and methods thus may be used to perform a Quantitative Risk Assessment (QRA), which includes performing multiple simulations of a proposed tripping schedule, each simulation based on a different set of input parameter values selected based on input parameter uncertainties. For example, a QRA method includes simulating the proposed tripping schedule using a set of input parameter values that includes expected values of each input parameter, and determining whether the proposed tripping schedule meets selected damage criteria. A new set of parameter values is selected, and the proposed tripping schedule is again simulated. At least one of the input parameters in the new set has a value that is different than the value in the previous set (within an associated uncertainty). The simulation is performed using the new set, and may be repeatedly performed using input parameter values that vary within the associated uncertainties. Upon completion of the simulations, a probability of success (POS) value is assigned to the tripping schedule based on the number of successful simulations, i.e., simulations that resulted in output parameters that meet the damage criteria.

In one embodiment, multiple tripping schedules are evaluated in order to determine a suitable or optimal tripping schedule. For example, multiple pre-selected tripping schedules are evaluated to determine a POS for each tripping schedule. A suitable tripping schedule may be selected based on the POS. In another example, an algorithm tunes or adjusts proposed tripping schedules or subsequently inputted tripping schedules based on the output from previous evaluations. For multiple tripping schedules, a POS curve or other suitable representation of the POS associated with each tripping schedule may be output or displayed.

The systems and methods described herein provide for the ability to estimate whether core damage from decompression might occur for given material parameters and tripping schedules. Such systems and methods also provide for automated quantitative evaluation of tripping schedules to generate a schedule that optimizes the trade-offs between key parameters, such as permeability, tripping speed and/or duration, and tensile rock strength. Furthermore, the systems and methods provide a systematic process to evaluate tripping schedules while accounting for uncertainties in various input parameters, and providing a more realistic assessment of tripping schedules, particularly where many of the input parameters applied to the model have associated uncertainties.

Referring to FIG. 1, an exemplary embodiment of a downhole drilling system 10 disposed in a borehole 12 is shown. A drill string 14 is disposed in the borehole 12, which penetrates at least one earth formation 16. Although the borehole 12 is shown in FIG. 1 to be of constant diameter, the borehole is not so limited. For example, the borehole 12 may be of varying diameter and/or direction (e.g., azimuth and inclination). The drill string 14 is made from, for example, a pipe or multiple pipe sections. The system 10 and/or the drill string 14 include a drilling assembly 18. In one embodiment, the drilling assembly is configured as a coring assembly or tool. Various measurement tools may also be incorporated into the system 10 to affect measurement regimes such as wireline measurement applications or logging-while-drilling (LWD) applications.

The drilling assembly 18, which may be configured as a bottomhole assembly (BHA), includes a drill bit 20 and is configured to be conveyed into the borehole 12 from a drilling rig 22. In one embodiment, the drilling assembly is a coring assembly configured to obtain core samples of the formation 16. The drill bit 20 in this embodiment is a coring bit incorporated as part of a coring or sampling tool. An exemplary tool includes a coring bit attached to a drill collar having an inner bore configured to receive and retain the core sample.

In one embodiment, one or more downhole components, such as the drill string 14 and the drilling assembly 18, include sensor devices 24 configured to measure various parameters of the formation and/or borehole. For example, one or more parameter sensors (or sensor assemblies such as LWD subs) are configured for formation evaluation measurements relating to the formation, borehole, geophysical characteristics and/or borehole fluids. These sensors may include formation evaluation sensors (e.g., resistivity, dielectric constant, water saturation, porosity, density and permeability), sensors for measuring geophysical parameters (e.g., acoustic velocity and acoustic travel time), and sensors for measuring borehole fluid parameters (e.g., viscosity, density, clarity, rheology, pH level, and gas, oil and water contents).

The sensor devices 24, drilling assembly 18 and other downhole components may be included in or embodied as a BHA, drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

In one embodiment, the drilling assembly 18 and sensor devices 24 are configured to communicate with one or more processors, such as a downhole electronics unit 26 and/or a surface processing unit 28. The processor(s) may receive data and communication signals from the downhole components and/or transmit control signals to the components. Signals and data may be transmitted via any suitable transmission device or system, such as a cable 30. Other techniques used to transmit signals and data include wired pipe, electric and/or fiber optic connections, mud pulse, electromagnetic and acoustic telemetry.

The processor or processors, in one embodiment, are configured to receive data and generate information such as a mathematical model for prediction of downhole parameters and conditions. For example, the processor is configured to receive downhole data as well as additional data (e.g., from a user or database) such as geometric data of borehole components. The processor may be configured to perform functions such as providing prediction or modeling information, controlling the drilling assembly 18, transmitting and receiving data and monitoring the drilling assembly 18 and the drill string 14. The surface processing unit 28, the sensor devices 24 and/or other components may also include components as necessary to provide for storing and/or processing data collected from various sensors therein. For example, the surface processing unit 28 includes a processor 32, a data storage device (or a computer-readable medium) 34 for storing, data, models and/or computer programs or software 36.

Although the processors described herein are shown in communication with downhole components, they are not so limited. For example, a processor can be embodied as an independent computer or other processing device that can receive input data such as model parameters, measurement information and proposed tripping schedules.

Generally, some of the teachings herein are reduced to an algorithm that is stored on machine-readable media. The algorithm is implemented by a computer or processor such as the surface processing unit 28 and provides operators with desired output.

In one embodiment, the surface processing unit 28 or other processing device (also referred to as a "processor") is configured to generate a model that simulates potential core damage based on inputted tripping schedules. The model may be used to estimate or select an optimum or suitable tripping schedule. A "suitable tripping schedule," in one embodiment, is a schedule that results in removal of core samples within an acceptable time frame while reducing potential core damage to an acceptable level or otherwise satisfying core damage criteria. In addition to simulating potential damage, the processing device may be configured to analyze inputted tripping schedules and select or calculate an optimum or suitable tripping schedule.

In one embodiment, the model is used to compute the external pore pressure and stress history based on proposed tripping schedules, which in turn is applied as external loads and boundary conditions. The method computes pore pressures and stresses at different points in time based on inputted tripping schedules, and predicts pore pressure differences. These are used to evaluate a rock strength criterion (e.g., but not limited to tensile rock strength) to predict potential core damage.

In one embodiment, the processing device uses an algorithm that automates an iterative process of evaluating proposed tripping schedules. For example, the algorithm applies a plurality of proposed tripping schedules (potentially a large number of tripping schedules) to predict a pool of modeled core parameters, from which the algorithm can select the optimum or suitable tripping schedule. The algorithm may further include the ability to alter proposed tripping schedules in order to narrow in on the suitable schedule.

In one embodiment, the processing device utilizes a quantitative (mathematical and/or numerical) method that models a formation sample core tripping out of a borehole as a permeable, elastic solid with an initial pore pressure and stress distribution, to which variable external pressures and/or loads are applied based on material parameters of the core and inputted and/or generated tripping schedules.

Figure 2:
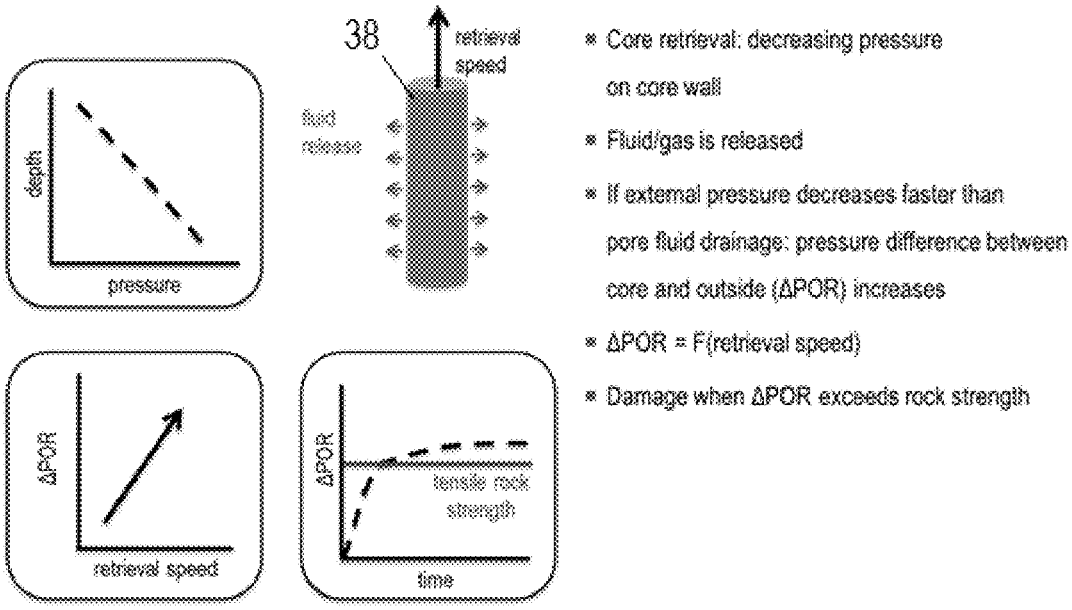
FIG. 2 depicts aspects of a model of a sample core of an earth formation and evaluation of core damage due to tripping.

FIG. 2 illustrates aspects of a core decompression analysis that may be used to evaluate the core and potential damage to the core that can occur during tripping. This analysis serves to connect core decompression damage to tripping or retrieval speeds. As discussed further below, the analysis is performed using a set of input parameter values, one or more of which may be associated with an uncertainty range. The analysis may be repeated for multiple sets of input parameter values that are varied for each analysis based on the uncertainty range(s).

During tripping, as a core sample 38 is retrieved and the depth at which the core sample decreases, pressure on the wall of the sample decreases. At least due to this decrease in pressure, fluid and/or gas is released from the sample, which reduces the internal fluid pressure in the sample. At some retrieval speed, the external pressure on the core becomes less than the internal pressure, resulting in a pressure difference ($\Delta$POR) between the internal and external pressure. This pressure difference changes as a function of retrieval speed (and potentially other factors). For example, $\Delta$POR may increase linearly with increases in retrieval speed, as shown in FIG. 2, however the function by which $\Delta$POR changes with retrieval speed is not limited to this example or a linear function. In order to evaluate tripping schedules, a model of the core and of various forces and conditions on the core is generated, and potential damage to the core is simulated or predicted for each tripping schedule. For example, the tensile rock strength of the core sample is estimated or simulated based on various input parameters, and output parameters such as pore pressure and stress are estimated and compared to damage criteria. For example, a tripping schedule is applied to the model and $\Delta$POR is calculated for multiple time and/or depth intervals. If $\Delta$POR increases beyond a selected threshold, which is calculated based on the tensile rock strength, then the core is considered to be damaged (or at least damaged beyond an acceptable amount).

The processor is thus configured to analyze tripping schedules by estimating parameters of the core based on a model and a proposed tripping schedule, and comparing one or more output parameters to selected core damage criteria. The core damage criteria may include threshold parameter values associated with potential damage (or an unacceptable degree of damage).

In one embodiment, one or more of the input parameters are assigned an uncertainty range, which may be a preprogrammed range, a range that is calculated by the processor in response to information from a user (e.g., sensor type, formation properties, operational parameters such as fluid parameters), and/or a range that is directly selected or input by the user. The processor performs a quantitative risk assessment (QRA) method that uses the uncertainty range to define a plurality of values for the parameter, run the model using each value to generate a probability of success (POS) for a given tripping schedule. The POS may be used by the processor and/or a user to determine whether the tripping schedule is suitable by meeting or exceeding a selected POS threshold. The processor may calculate a POS for a plurality of different tripping schedules, and generate an analysis result such as a POS curve that allows a user to visually inspect the risks involved in different tripping schedules and adjust the POS threshold.

The processor may include any number of processing components or modules that execute algorithms and software that allows a user to perform a decompression analyses during coring to obtain a safe retrieval rate where the internal pore pressure in the core doesn't fracture the core. For example, the processor includes a display module, an input module, a modeling module, and a POS calculation module.

For example, the input and display modules incorporate a touch screen (e.g., on a tablet or smartphone). The modeling module may include a physics engine that performs the decompression analysis. For maximum flexibility, input and output may be generated according to a common protocol or data type, such as ascii text files with appropriate syntax. This allows the physics engine to be written in any practical language and to be easily integrated into other modeling and simulations solutions in the future.

Figure 3:
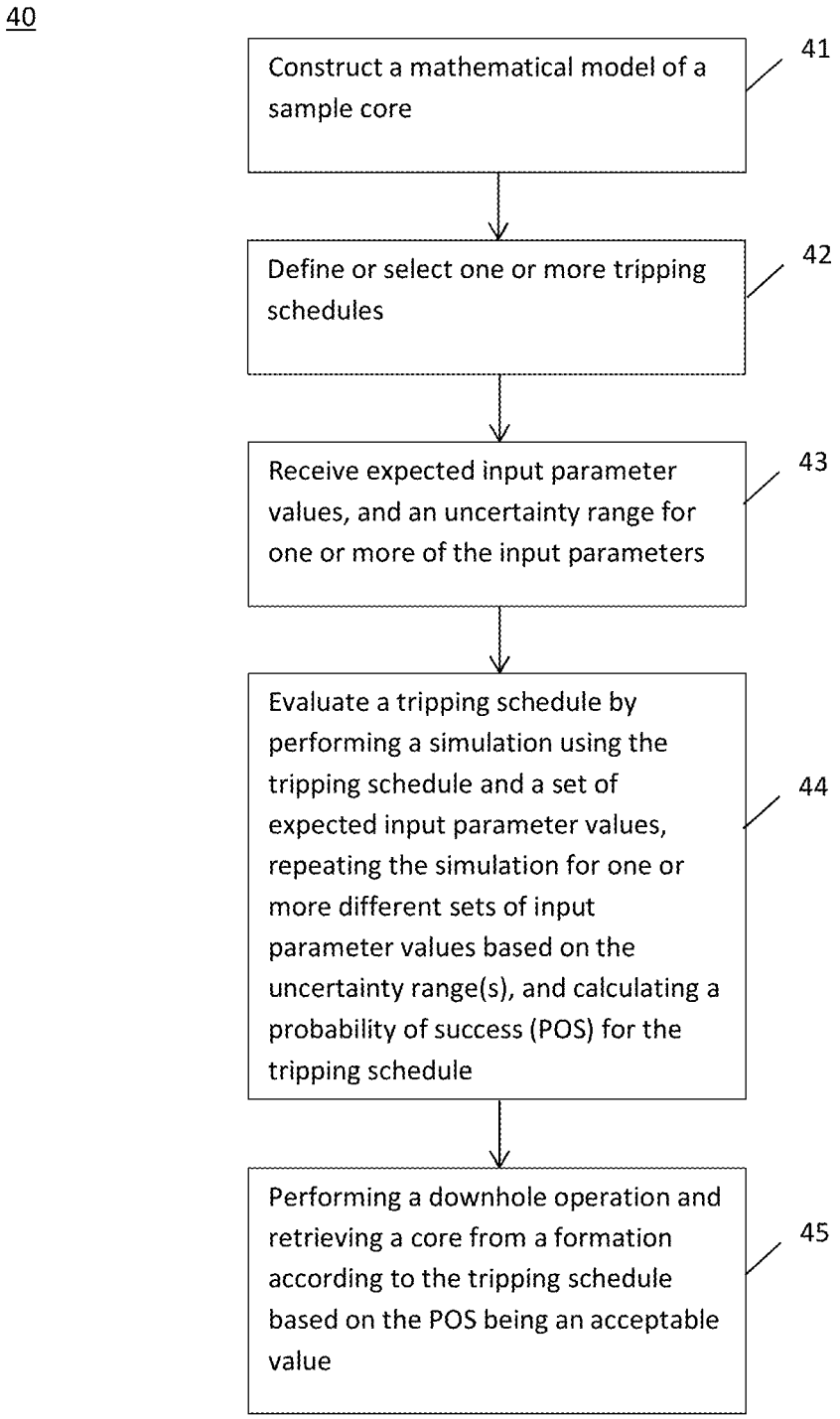
FIG. 3 is a flow chart providing an exemplary method of evaluating tripping schedules and determining a suitable tripping schedule.

FIG. 3 illustrates a method 40 for evaluating tripping schedules and determining one or more optimum or suitable tripping schedules. The method provides a quantitative prediction of a tripping schedule that reduces or minimizes damage from core decompression while tripping out of a bore hole. The method 40 includes one or more of stages 41-45 described herein, at least portions of which may be performed by a processor (e.g., the surface processing unit 28). In one embodiment, the method includes the execution of all of stages 41-45 in the order described. However, certain stages 41-45 may be omitted, stages may be added, or the order of the stages changed.

Although the systems and methods described herein relate to drill string coring, they are not so limited. For example, the systems and methods may apply to wireline coring (e.g., the coring tool of system 10 is a wireline coring/core removal tool).

In one embodiment, the method is performed as specified by an algorithm that allows a processor (e.g., the surface processing unit 28) to automatically calculate an optimum or suitable tripping schedule and/or calculate a probability of success (POS) for one or more schedules. The processor as described herein may be a single processor or multiple processors (e.g., a network). The algorithm output may be a single schedule or a plurality of schedules that satisfy different criteria (e.g., time or damage).

The method can be used iteratively to obtain a suitable tripping schedule. The suitable tripping schedule may be one that minimizes or avoids predicted core damage while maintaining the total tripping time to within a desired limit. Short tripping times are desired as they provide economic benefits, e.g., save time and money.

In the first stage 41, a mathematical model of a formation sample core (also referred to simply as a "core") is constructed. The model may be a quantitative analytical or numerical model of a poro-elastic core that can be subjected to varying external boundary conditions and pressure loads.

Various properties of the core are selected or inputted as various model parameters. As described herein, "properties" of the core or "parameters" include any data or information used to construct the model, and/or information received from simulation outputs. Such parameters include, for example, geometric properties and material parameter data providing information relative to formation characteristics such as formation rock properties, other formation material properties and properties of fluid in the formation.

Geometric data related to the drill string and the core is input to generate representations of the geometry of the core. Exemplary geometric parameters include length, diameter and depth. In one embodiment, the modeled core is assumed to have a cylindrical shape, having a diameter that is much smaller than its height, although any shape could be used.

An exemplary model is generated using the finite element method. In one embodiment, multiple elements are generated from the geometric data that correspond to the shape or geometry of different portions of the core geometry. In one embodiment, the core or a portion thereof is modeled as a three-dimensional model using finite three dimensional elements.

The model is not limited to the embodiments described herein, as any mathematical model that permits prediction of pressure conditions in a simulated core may be used. In one embodiment, the model may be a mathematical/analytical model instead of a numerical model. In other embodiments, a simplified numerical model may be used, such as a two-dimensional or one-dimensional model. For example, the model may be a simplified one-dimensional diffusion model that simulates a central profile along the core's radius. Such a simplified model may be desirable as it can be solved faster, thereby allowing for a larger number of iterations or a quicker result.

Material parameters are also estimated or selected for the core. The material parameters may be based on measurements taken downhole in the current borehole in which the core is to be removed, taken from previous measurements or otherwise assumed or estimated based on knowledge of the formation. For example, the system 10 may be used to take various measurements to determine formation parameters such as permeability that can be used to generate the model.

In one embodiment, the material parameters include fluid parameters and/or formation rock parameters. Exemplary parameters include permeability, porosity, fluid density and viscosity, and rock strength.

Figure 4:
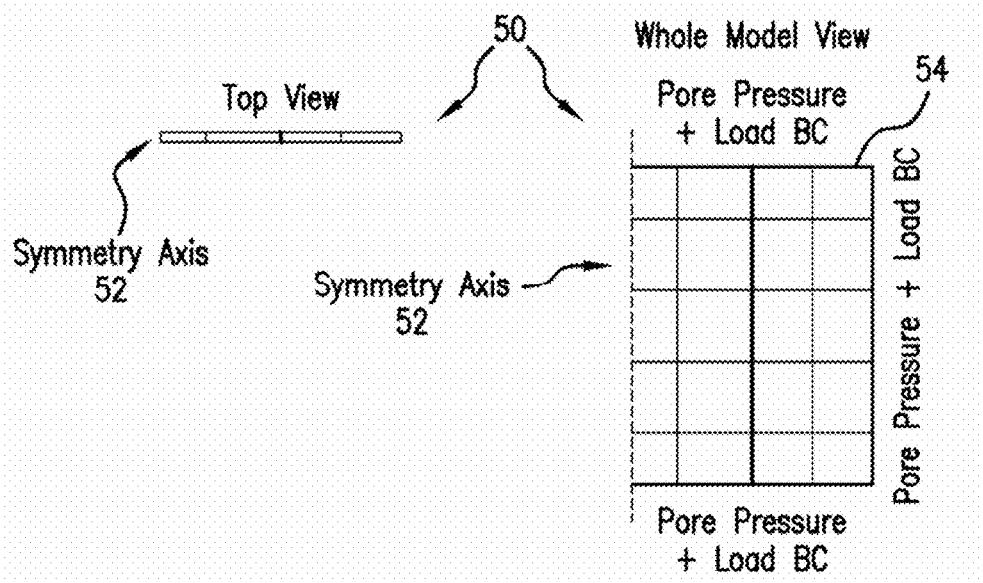
FIG. 4 depicts an embodiment of a mathematical model of a formation core sample.
Figure 5:
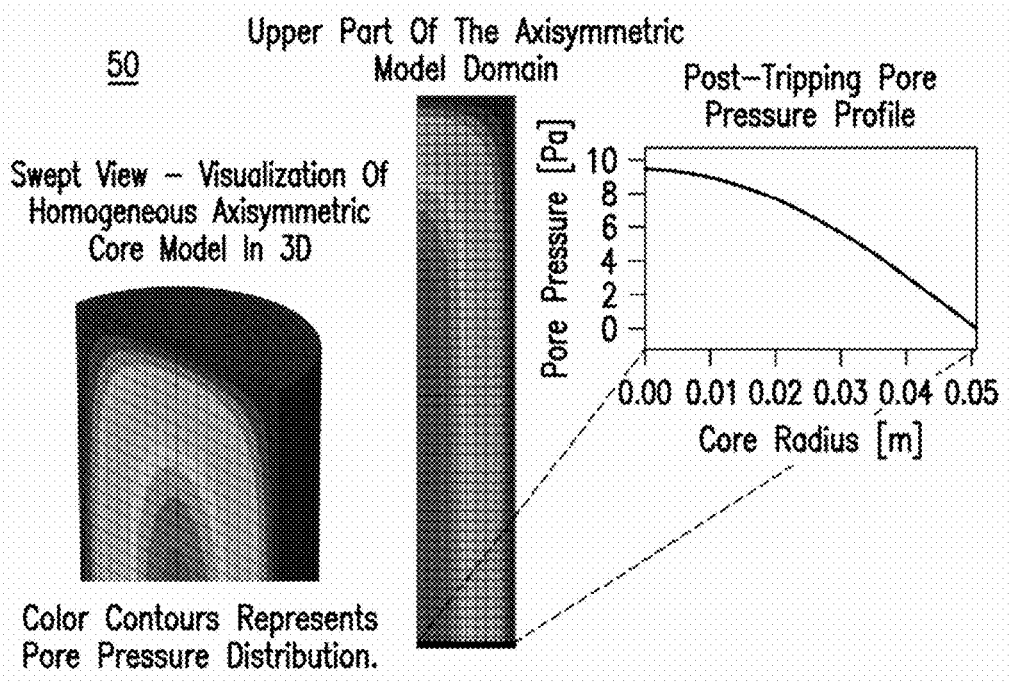
FIG. 5 depicts an exemplary pore pressure distribution in the model of FIG. 3.

An exemplary model 50 of a core is shown in FIGS. 4 and 5. The model 50 is an axisymmetric finite-element model of a core that contains a pore fluid. As shown in FIG. 4, the model is symmetric about a symmetry axis 52 corresponding to a central axis of a coring tool. The model is subjected to boundary conditions 54 such as stress boundary conditions based on formation pore pressure and stress from the mud column.

FIG. 5 shows the upper part of an exemplary pore pressure distribution in the core, calculated by the model 50 after tripping. As shown, the pore pressure in a mid-horizontal region of the core decreases radially from the center of the core toward the boundaries of the core. In this example, the pore pressure is color coded from red (indicating higher values) to blue (indicating lower values).

One or more of the inputted parameters are assigned an associated uncertainty. The associated uncertainty may be a single value or uncertainty range or may include multiple uncertainty values or ranges. For example, a parameter value is associated with a first uncertainty range (e.g., the first standard deviation) and may also be associated with a second uncertainty range (e.g., the second standard deviation) and any number of additional uncertainty ranges. Having a multiple of uncertainty ranges is useful, e.g., for evaluating different scenarios or conditions that can have different effects on the accuracy of sensor data.

In the second stage 42, tripping schedules are defined. Tripping schedules may be defined by receiving tripping schedules from a user or by generating the tripping schedules by the processor. In one embodiment, one or more proposed tripping schedules are input to the algorithm by a user. Each tripping schedule may be a linear schedule or a more complex schedule.

In one embodiment, each tripping schedule is defined by tripping velocity (or scalar equivalent being the speed) as a function of depth. For example, each tripping schedule is specified by distinct points of depth and velocity pairs. The schedule can be specified directly or constructed, e.g., by linearly interpolating between a small number of depth/velocity points or by assigning constant tripping velocities for certain depth ranges. The velocity information may be used with depth differentials to obtain tripping times, e.g., the time duration of portions of the tripping schedule and/or the entire tripping time.

A tripping schedule may be constant or variable over a given depth interval. For example, the tripping schedule may prescribe an at least approximately constant tripping speed over the length of the borehole, a step pattern tripping schedule that prescribes different constant tripping speeds at different intervals. In other examples, the tripping schedule may prescribe a variable tripping speed that increases or decreases linearly with time and/or depth, or a non-linear tripping schedule.

In the third stage 43, the processor receives values for each of one or more input parameters. One or more of the input parameters are assigned an uncertainty range. The uncertainty range can be fixed, variable, set by a user via a GUI, or pre-selected. For example, default uncertainties can be pre-set, which can be adjusted or replaced by a user. Uncertainty values are described below as multiples of the standard deviation but are not so limited. Examples of input parameter values are discussed further below.

In the fourth stage 44, the processor calculates a probability of success (POS) for each tripping schedule. The probability of success is the probability of retrieving the sample without damage (e.g., fracturing) or without an amount of damage beyond an acceptable level.

An acceptable POS may be any value. For example, the acceptable or target POS is 100% or close to 100%, or is selected to be a lower value. The POS can be selected as desired to balance the need for reducing or minimizing damage with the need to retrieve the sample as quickly as feasible or otherwise in a timely manner.

In order to determine the POS for a given tripping schedule, the processor applies the tripping schedule and a set of input parameter values (values of one or more input parameters) to the model to predict one or more output or predicted parameter values. The set of input parameter values includes a value for each parameter. For a parameter that has an uncertainty range, a value for the parameter is selected from within the uncertainty range. The one or more output parameters are compared to core damage criteria to determine whether the one or more output parameters are within an acceptable range (e.g., within a selected value range, at or below a selected maximum, or at or above a selected minimum). If the output parameter values are within the acceptable range, the tripping schedule is predicted to avoid damage (or at least an unacceptable amount of damage) to the core. The tripping schedule can then be considered to "pass" the evaluation for this set of parameters. Conversely, if the output parameters are outside the acceptable range, the tripping schedule can be considered to "fail".

The processor then repeats the process by applying the tripping schedule and a different set of input parameters to the model. In the different set, at least one of the parameter values is different than the previous set. For a parameter having an uncertainty range, the value for that parameter is a different value selected from within the uncertainty range. In this way, the processor repeats the process for a plurality of different input parameter sets. A different input parameter set is considered to have at least one value of a parameter that is different than a value of a parameter in the previous sets.

For each model run, a "pass" or "fail" is designated. The POS is calculated based on the number of passes or fails for a given tripping schedule. In one embodiment, the POS is the percentage of model runs for a given tripping schedule that produces a pass result.

In the fifth stage 45, a tripping schedule having an acceptable POS is selected. During an energy industry operation (e.g., a drilling operation, logging while drilling operation, formation evaluation operation, wireline operation, and others). A core is taken from a formation via suitable coring tool, and the core is retrieved at the selected tripping schedule. It is noted that the method can be performed during an operation, prior to tripping and/or during tripping. For example, the method can be repeated during retrieval to account for changing conditions or measurement data retrieved during tripping. The tripping schedule can be modified at any time or a new tripping schedule selected based on the method.

The following describes an example of how the model is used to predict a core parameter. First, initial conditions are set for the model. For example, initial values for external loads (e.g., stress) and pore-fluid pressure on the core are assigned and applied as boundary conditions to obtain an initial pore pressure distribution. The external stress and pore pressure values may be based on actual measurements, known properties of the formation and borehole, and/or depth information.

In one embodiment, the external stress and pore pressure are based on the mud weight column at the starting depth of the core, i.e., the depth of the core prior to tripping. For example, the in-situ pore pressure and the in-situ stress on the core at each depth are considered to be equal to the hydrostatic burden of drilling fluid in a borehole at that depth, given by (mud density)*g*(depth), where g is the acceleration due to gravity.

In one embodiment, a pressure amplitude is calculated for each depth. The pressure amplitude may be an amplitude of the pore pressure at a selected location of the model or the model boundary. For example, the pressure amplitude is the external pore pressure at a selected location on the core.

The pore pressure distribution in the core (or other pore pressure value, such as maximum pore pressure) is calculated at each depth point in the tripping schedule based on the model. For example, as the tripping schedule proceeds from the starting depth toward the surface, at each depth point or increment, the model is subjected to successively decreasing external pressure (i.e., successively decreasing external pore-pressure and stress boundary conditions). The model incrementally adjusts the pore pressure and the stress inside the core in response to the changing boundary conditions. As a result, core parameter values in the core at each tripping schedule increment are generated. The core parameter values may be output or displayed to a user as, e.g., a core parameter curve as a function of depth or time.

Each proposed tripping schedule is applied as an input to the model to generate core parameter values as a function of time and/or depth. For each proposed tripping schedule, the external pore pressure and stress are set as boundary conditions based on the depth of elements of the simulated core during the proposed tripping schedule.

The core parameter values calculated for each tripping schedule are compared to selected criteria related to potential core damage, time and/or other considerations. The time criteria may include the duration of the tripping process (e.g., the entire process or a portion thereof). Core damage criteria are related to potential core damage during tripping and/or factors that may affect the quality of the core sample. Core damage criteria may include values of any suitable properties of the core, formation and/or borehole during tripping. Such core damage criteria includes, for example, property values relating to stress, temperature, pressure, vibration, deformation and others, as well as the rate of change of such properties.

Using one or more of the criteria, a suitable tripping schedule is selected that reduces or minimizes core damage while also maximizes the overall speed of removal. The suitable tripping schedule is not so limited, as it may be selected to satisfy any selected criteria, e.g., quality, time and economic criteria.

In one embodiment, the parameter values are compared to core damage criteria at every tripping schedule point or increment to determine whether and/or how much core damage is predicted to occur at each time. The core damage criteria may include threshold parameter values associated with potential damage (or an unacceptable degree of damage). Other criteria include, for example, a duration of the tripping schedule during which core parameter values exceed a threshold and a number of data points for which core parameters values exceed a threshold. For example, the pore pressure differential calculated for each increment is compared to a selected threshold or pressure differential range associated with the tensile rock strength of the core.

In one embodiment, the proposed tripping schedule that predicts the least amount of core damage and/or meets the selected criteria is selected as the optimum or suitable tripping schedule. In one embodiment, after applying the proposed tripping schedules to the model, one or more of the proposed tripping schedules are iteratively adjusted and applied to the model until a proposed tripping schedule is considered suitable, e.g., meets core damage criteria.

Figure 6:
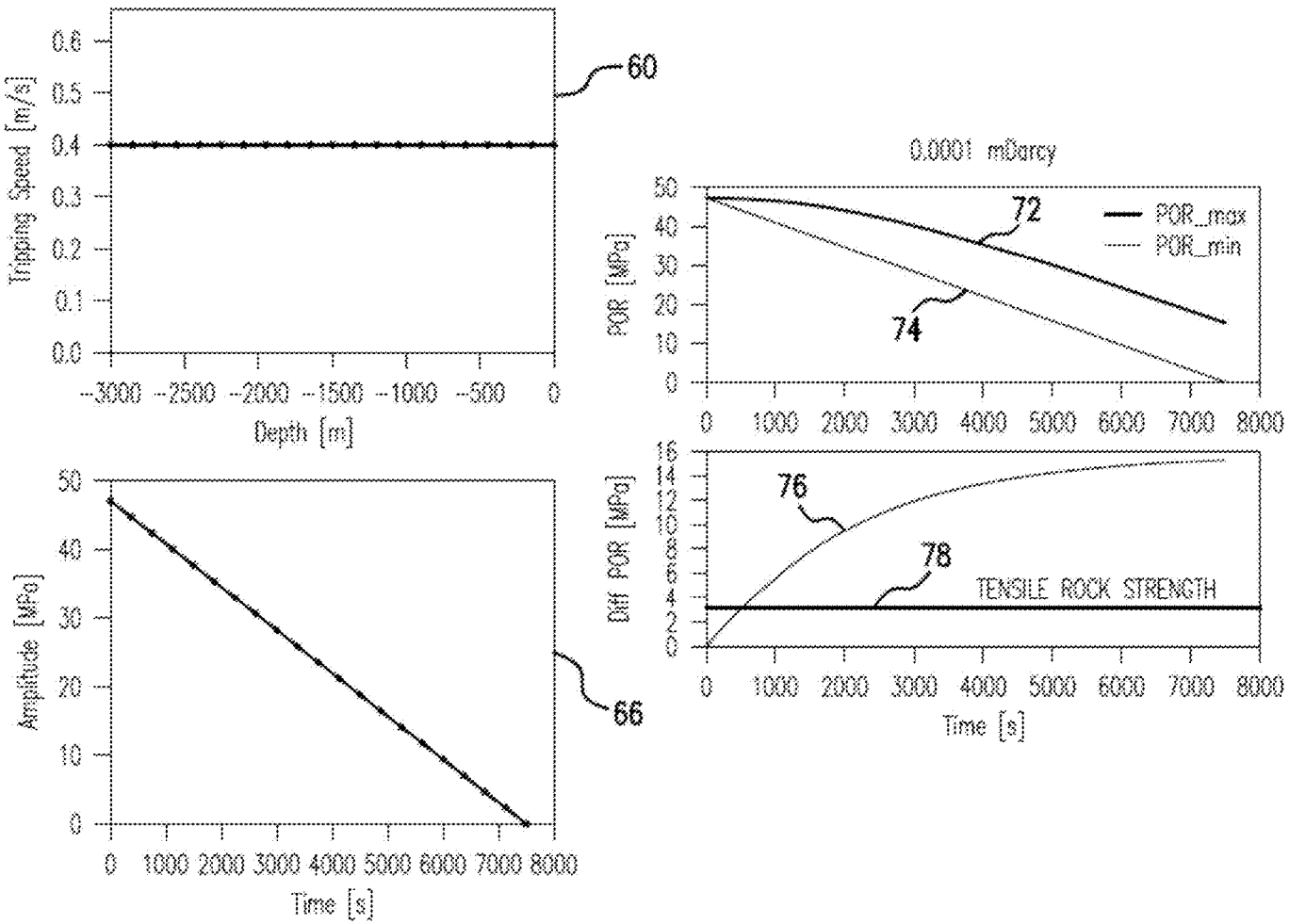
FIG. 6 depicts a proposed tripping schedule and core parameters resulting from application of the proposed tripping schedule to the model.
Figure 7:
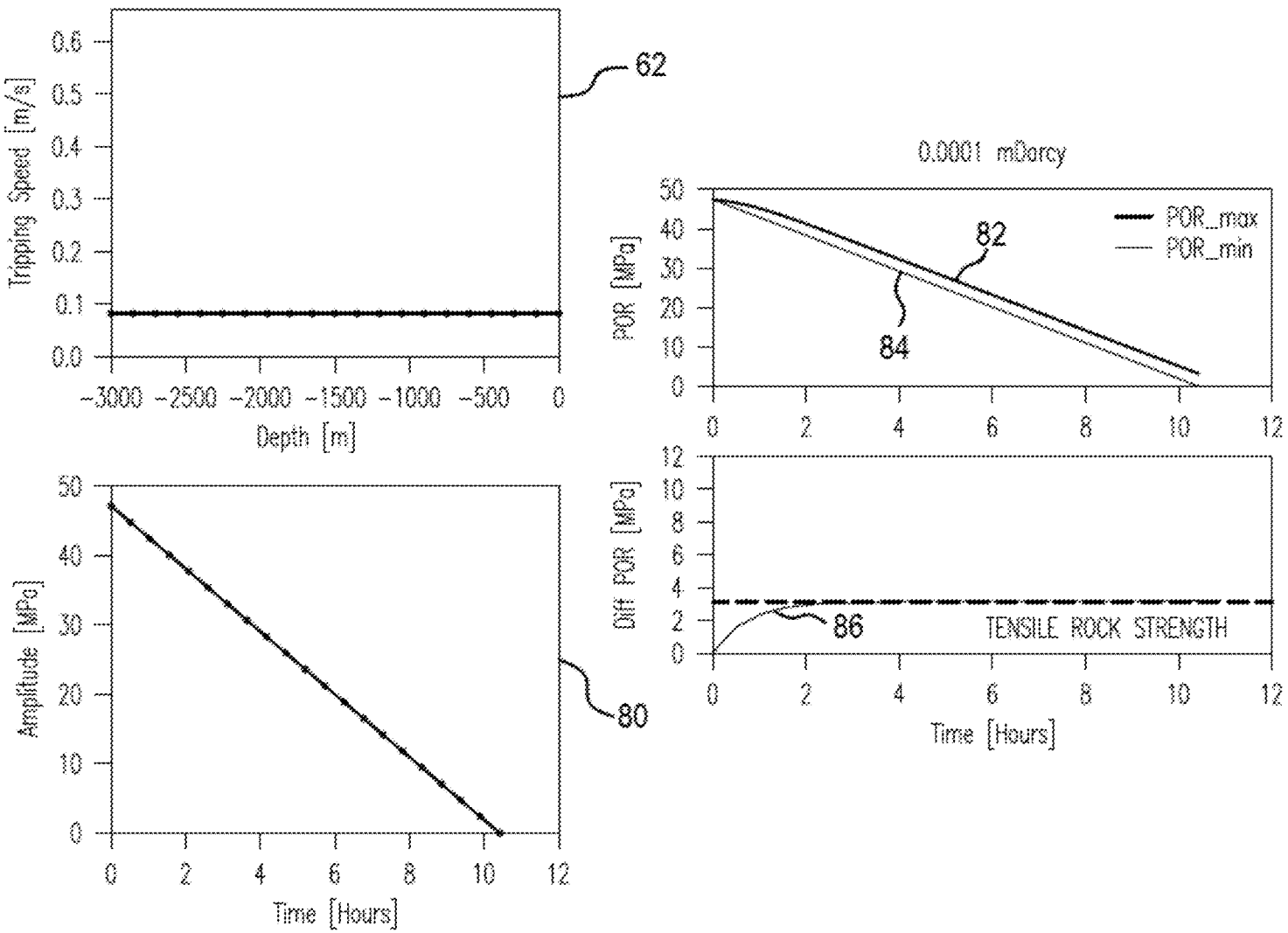
FIG. 7 depicts a proposed tripping schedule and core parameters resulting from application of the proposed tripping schedule to the model.
Figure 8:
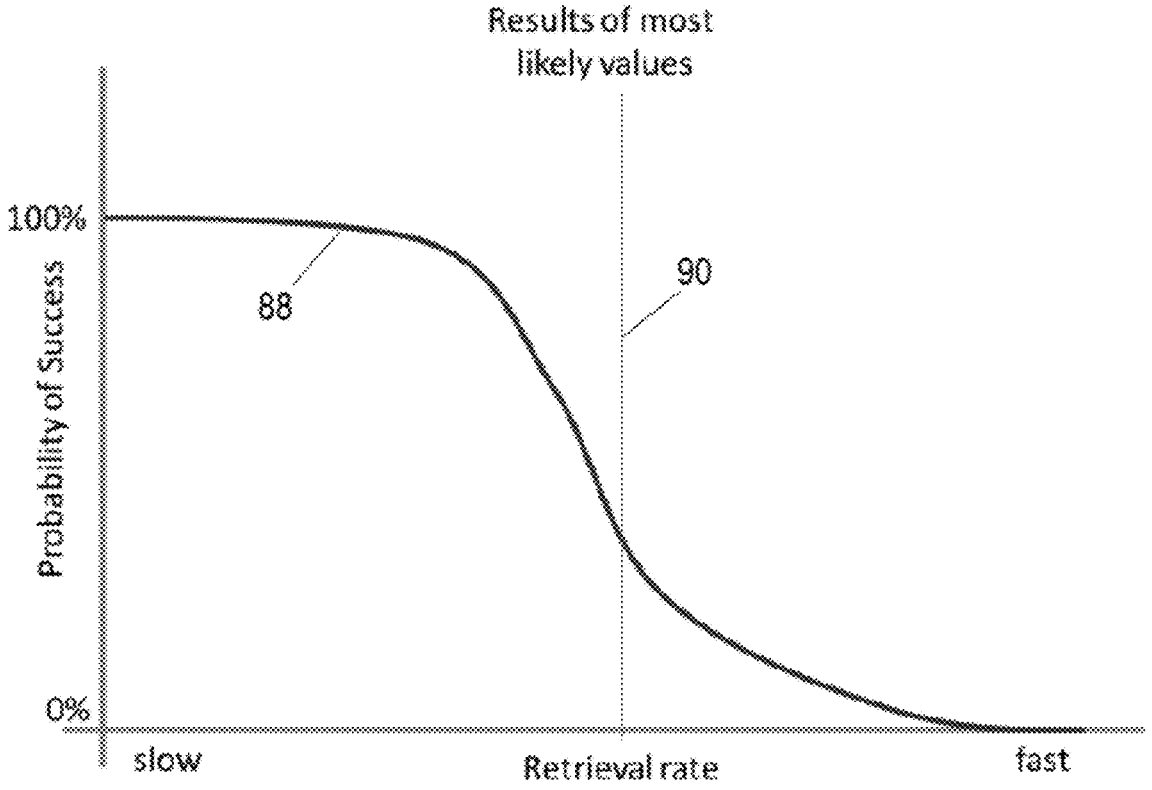
FIG. 8 depicts a display of a probability of success curve generated according to embodiments described herein.

FIGS. 6-8 illustrate examples of the method 40, which are performed by a processor. In this example, the method includes constructing an axisymmetric finite-element model of a core, such as the model 50. The geometric parameters and all necessary material parameters are known or estimated. The geometric parameters of the core in this model are a core diameter of four inches and a core length of one meter. The depth of the core (i.e., the starting depth of proposed tripping schedules) is about 3,000 meters.

The material parameters selected for the model in this example are shown in the following table (Table 1). In these results, all or some of the following properties are analyzed (e.g., via a core model) to estimate differential pressures and potential core damage due to tripping speed and/or patterns. All non-scalar material parameters are assumed isotropic.

TABLE 1

| | Example value |
|---|---|
| Geometric parameter | |
| Core diameter | 0.1 m (4 in) |
| Depth (TVD) | 3000 m |
| Material properties (Rock) | |
| Permeability | $9.869 \times 10^{-21}$ m$^2$ – $9.869 \times 10^{-19}$ m$^2$ ($10^{-5}$ mDarcy – $10^{-3}$ mDarcy) |
| Porosity (void ratio) | 0.15 |
| Tensile rock strength | 3 MPa |
| Rock bulk modulus | 5 GPa |
| Young's modulus | 9 GPa |
| Poisson's ratio | 0.2 |

TABLE 1-continued

| | Example value |
|---|---|
| Fluid properties (Fluid/Gas) | |
| Fluid kinematic viscosity | $3.6 \times 10^{-7}$ m$^2$/s |
| Fluid density | 1030 kg/m$^3$ |
| Fluid bulk modulus | 1 GPa |
| Material properties (Drilling fluid) | |
| Drilling fluid density | $1.6 \times 10^3$ kg/m$^3$ (1.6 SG) |

In addition to the input parameters from Table 1, a retrieval or tripping schedule is used to compute the maximum pore pressure difference between the core and the mud column. This number is compared to the tensile rock strength to predict whether core decompression is to be expected or not.

Many of the above parameters may have uncertainties associated therewith. The processing device is able to take these uncertainties into account in a Quantitative Risk Assessment (QRA) method as described herein to calculate the probability of success (POS) for a given tripping schedule.

In this example, a first proposed tripping schedule 60 is provided to the processor. The first proposed tripping schedule 60 prescribes a constant tripping speed, and is described as a "flat" schedule. Tripping schedules in this and other examples are displayed as tripping speed as a function of depth.

The tripping speed and depth is used to correlate each depth with a time value, which is applied to the model with the parameters in Table 1, and an amplitude of pressure on the core is calculated at each depth of the core. In this example, the pressure amplitude is calculated based on the mud weight at each depth. A pressure amplitude curve 66 is calculated for the flat schedule 60. The pressure amplitude at each time is used to calculate the external boundary condition and load on the model at the corresponding tripping schedule increment.

Resultant pore pressure parameter values for the proposed tripping schedule 60 are calculated and shown as curves representing the maximum and minimum pore pressure in the core (e.g., maximum at center and minimum at or near edge or boundary) and the pore pressure differential. The resultant values for the proposed tripping scheduled may be stored and/or displayed to a user.

Each proposed tripping schedule is compared to selected damage criteria to determine whether any meet the criteria. In this example, the calculated pore pressure parameters are compared to threshold values indicative of core damage, to determine whether the proposed tripping schedules potentially cause core damage.

In the example of FIG. 6, the proposed flat schedule 60 results in a maximum pore pressure curve 72, a minimum pore pressure curve 74 and a differential pressure (ΔPOR) curve 76. In the present example, the calculated differential pressure values are compared to a differential pressure threshold of about 3 MPa, which is associated with an unacceptable level of core damage.

It is evident that the proposed flat schedule 60 results in a differential pressure that exceeds a threshold value 78 associated with the tensile rock strength over most of the duration of the proposed tripping. Thus, this schedule 60 is considered to "fail" for the present set of input parameters.

The processing device then selects a new set of input parameters based on the uncertainty range provided for a given parameter. For example, the same set of input parameters shown in Table 1 is used for the model, except that the porosity value is changed (e.g., to 1.4). The processor again evaluates the tripping schedule and determines whether the schedule 60 would pass given the new set of input parameters. The schedule is repeatedly evaluated, each time with a different set of input parameters. Once the evaluation is performed for each set, a POS value is calculated by calculating the percentage of evaluations that result in a "pass".

In one embodiment, the processing device calculates a POS value for each of a plurality of different tripping schedules. For example, a second tripping schedule 62, which is a flat schedule representing a lower tripping speed than the schedule 60, is similarly evaluated. As shown in FIG. 7, the second tripping schedule 62 is evaluated using the model and the input parameters of Table 1 to produce a pressure amplitude curve 80, a maximum pore pressure curve 82, a minimum pore pressure curve 84 and a pore pressure differential curve 86. As shown in FIG. 7, the differential pore pressure is maintained at about the threshold level, and thus the schedule 62 is considered to "pass" for this set of input parameters. As above, the schedule 62 is evaluated for multiple different input data sets to calculate a POS for the schedule 62.

In addition to effects of pressure release while tripping out, additional mechanisms may affect core integrity and lead to core damage. Such mechanism include the effect of a mud cake, in-situ stress orientations, external stress release during drill out, temperature reduction and exposure to non-native fluids. The method described herein may be used in conjunction with other techniques or methods that account for such mechanisms in evaluating tripping schedules and ensuring acceptable or maximum core integrity.

The following is a description of an example of the methods described herein. In the following description, various tripping schedules are defined as flat schedules having an at least substantially constant tripping speed, although other tripping schedule functions can be used.

In this example, the values of expected parameters are input to the processor, e.g., via user selection. Examples of expected parameters are shown above in Table 1. For each input parameter (or for one or more of the input parameters), the selected value is accompanied by an uncertainty range. For example, a user may select an expected porosity value of 20%, with an uncertainty range defined by the first standard deviation (e.g., +/−3%).

For each parameter that has an uncertainty, the processor selects values associated with a worst case scenario, i.e., a combination of parameter values that represent conditions most likely to result in core damage. For example, the worst case scenario parameters can include the lowest permeability, highest viscosity, lowest tensile strength etc. In this example, the uncertainty range for a parameter is the first or second standard deviation. The processing device evaluates multiple tripping speeds or times, and determines (e.g., by linear interpolation between the time steps) what the slowest retrieval is necessary for the worst case scenario. The processing device repeats the same process for a best case scenario (e.g. high permeability, low viscosity, etc.) and determines the fastest retrieval time for the best case scenario. The processing device then selects or defines a plurality of retrieval rates between the fastest and slowest trip schedule.

The processor, for all time steps, runs a simulation using the model and the expected values. Using linear interpolation, the processing device determines an expected retrieval rate based on the expected values of the input parameters.

Thus, the processing device calculates three tripping rates: a maximum tripping rate, a minimum tripping rate and an expected tripping rate. These tripping rates (along with additional tripping rates between the maximum and minimum if desired) are evaluated as discussed above. For each tripping rate, the model simulation is run for various combinations of parameter values selected to be within their respective uncertainties.

For example, for each retrieval rate, a Monte Carlo simulation is performed with all input values. Each simulation returns a TRUE (i.e., pass) or FALSE (i.e., fail) depending on whether the simulation resulted in acceptable core damage. After the Monte Carlo simulation, the POS for that retrieval rate can be calculated form the returned values. For example, for 1,000 runs (each representing a different combination of input parameter values), 743 result in a pass, thus the POS is 74.3%.

The results may be plotted in a visual form, such as a POS curve 88 showing the POS for various retrieval rates or tripping schedules. FIG. 8 shows an example of a POS curve showing retrieval rate vs. POS plot. The retrieval rate calculated based on the expected values is denoted by line 90. The display provides an effective and intuitive tool to demonstrate to a use the effects of changing the tripping schedule As shown in FIG. 8, the POS curve demonstrates that very slow rates are mostly or always successful (100% POS), and sufficiently fast rates are mostly or always unsuccessful (0% POS). An acceptable POS can be selected by a user or otherwise defined as needed. In some cases, a 50% POS may be acceptable, or a higher POS may be needed (e.g., 90%). The user can select the POS that best represents the balance between time needed for retrieval and the potential for damage.

Although the examples and embodiments above are described in the context of tripping schedules that include constant retrieval rates (fully constant or step pattern), they are not so limited, as the embodiments can be used with variable retrieval rates. For example, in the POS curve of FIG. 8, if the tripping schedules are variable, you could replace x-axis with a value representative of the variable retrieval rate, such as maximum rate in the schedule, total tripping time, average retrieval rate, etc.

The systems and methods described herein provide various advantages over prior art techniques. For example, the systems and methods allow for automated selection and/or generation of a tripping schedule for removal of a formation core sample that results in minimal or reduced core damage without requiring user intervention. The systems and methods described herein help to ensure that core samples can be removed as quickly as possible without breaking or otherwise being significantly damaged.

Embodiments described herein also provide the ability to make improved recommendations that account for uncertainties in data, and allow users to more reliably assess the potential impact of different tripping schedules and more effectively balance the need to retrieve a sample suitable for testing with the need for fast retrieval.

Decompression damage during core retrieval is of great concern in low-permeability formations because, when the core is retrieved too quickly, pore fluid pressure cannot equilibrate with the decreasing load conditions in the mud column. When the pore fluid pressure difference between the core and the surrounding mud column exceeds the tensile strength of the formation, core decompression damage can be expected.

Conventional advice in the field is to retrieve the core 'slowly'. However, operators also want to retrieve core as quickly as possible to minimize operational expenses. Embodiments described herein provide methods that identify the shortest retrieval time for which core decompression damage is prevented.

In conventional plays, experience by operators is typically employed to determine appropriate tripping speeds. Embodiments described herein provide a significant improvement by allowing operators to retrieve cores faster than they have before without compromising core quality, resulting in time and cost savings.

In unconventional plays where low-permeability formations are common, experience from conventional plays is typically not applicable. Here, 'slow' retrieval schedules are not always successful, which exposes the possibility of significant decompression damage that can render cores unusable for testing. This in turn can transform the entire coring operation into a worthless endeavor. Embodiments described herein address this concern by providing accurate and reliable assessment of tripping speeds and schedules.

Embodiment 1

A method for evaluating a schedule for removing a core sample from a borehole, the method comprising: taking the core sample within the borehole with a sampling tool; generating a model of the core sample based on a plurality of input parameters, the generating including applying a value of each of the input parameters, wherein one or more of the input parameter values is associated with an uncertainty range; defining a proposed tripping schedule, and performing, by a processor, an evaluation of the proposed tripping schedule, the evaluation including applying the proposed tripping schedule and a set of expected input parameter values to the model, estimating a core parameter and determining whether the tripping schedule is predicted to be successful by comparing the core parameter to selected core damage criteria; iteratively repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a value of the at least one parameter in a previous evaluation and within the uncertainty associated with the at least one parameter, each evaluation being performed using a different combination of input parameter values than any other evaluation; calculating a probability of success (POS) of the proposed tripping schedule based on a number of evaluations that result in the tripping schedule being predicted to be successful; and selecting the proposed tripping schedule based on the POS having an acceptable value.

Embodiment 2

The method of any prior embodiment, wherein repeating the evaluation includes iteratively performing the evaluation using a plurality of different sets of input parameter values, each different set of input parameter values having a value of at least one parameter that is adjusted relative to a previous evaluation within the uncertainty associated with the at least one parameter.

Embodiment 3

The method of any prior embodiment, further comprising removing the core sample through the borehole according to the proposed tripping schedule based on the POS having an acceptable value.

Embodiment 4

The method of any prior embodiment, further comprising calculating a POS of a plurality of proposed tripping schedules.

Embodiment 5

The method of any prior embodiment, further comprising generating a POS curve indicating the POS of each tripping schedule.

Embodiment 6

The method of any prior embodiment, further comprising selecting one of the plurality of proposed tripping schedules, and removing the core sample according to the selected proposed tripping schedule.

Embodiment 7

The method of any prior embodiment, wherein the model is a finite-element model of the core sample, and applying the proposed tripping schedule includes applying a boundary condition to the model at each increment of the proposed tripping schedule based on a depth of the core sample at each increment.

Embodiment 8

The method of any prior embodiment, wherein the core parameter includes a differential pore pressure in the core sample based on external stress and pore pressure incident on the core sample at each increment.

Embodiment 9

The method of any prior embodiment, wherein determining whether the tripping schedule is predicted to be successful includes comparing the differential pore pressure to a threshold pressure estimated based on tensile rock strength.

Embodiment 10

The method of any prior embodiment, wherein the proposed tripping schedule prescribes an at least substantially constant tripping speed along a selected interval of the borehole.

Embodiment 11

A system for evaluating a schedule for removing a core sample from a borehole, the system comprising: a carrier configured to transport the core sample through at least part of the borehole; and a processor configured to evaluate a tripping schedule for removing the core sample, the processor configured to perform: generating a model of the core sample based on a plurality of input parameters, the generating including applying a value of each of the input parameters, wherein one or more of the input parameter values is associated with an uncertainty range; defining a proposed tripping schedule, and performing an evaluation of the proposed tripping schedule, the evaluation including applying the proposed tripping schedule and a set of expected input parameter values to the model, estimating a core parameter and determining whether the tripping schedule is predicted to be successful by comparing the core parameter to selected core damage criteria; repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a value of the at least one parameter in a previous evaluation and within the uncertainty associated with the at least one parameter, each evaluation being performed using a different combination of input parameter values than any other evaluation; and calculating a probability of success (POS) of the proposed tripping schedule based on a number of evaluations that result in the tripping schedule being predicted to be successful.

Embodiment 12

The system of any prior embodiment, wherein the processor is configured to control removal of the core sample through the borehole according to the proposed tripping schedule based on the POS having an acceptable value.

Embodiment 13

The system of any prior embodiment, wherein repeating the evaluation includes iteratively performing the evaluation using a plurality of different sets of input parameter values, each different set of input parameter values having a value of at least one parameter that is adjusted relative to a previous evaluation within the uncertainty associated with the at least one parameter.

Embodiment 14

The system of any prior embodiment, wherein the evaluation is repeatedly performing according to a Monte Carlo algorithm.

Embodiment 15

The system of any prior embodiment, wherein the processor is configured to calculate a POS of a plurality of proposed tripping schedules.

Embodiment 16

The system of any prior embodiment, wherein the processor is configured to generate a POS curve indicating the POS of each tripping schedule.

Embodiment 17

The system of any prior embodiment, wherein the processor is configured to select one of the plurality of proposed tripping schedules, and control removal of the core sample according to the selected proposed tripping schedule.

Embodiment 18

The system of any prior embodiment, wherein the model is a finite-element model of the core sample, and applying the proposed tripping schedule includes applying a boundary condition to the model at each increment of the proposed tripping schedule based on a depth of the core sample at each increment.

Embodiment 19

The system of any prior embodiment, wherein the core parameter includes a differential pore pressure in the core sample based on external stress and pore pressure incident on the core sample at each increment.

Embodiment 20

The system of any prior embodiment, wherein determining whether the tripping schedule is predicted to be successful includes comparing the differential pore pressure to a threshold pressure estimated based on tensile rock strength.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for evaluating a schedule for removing a core sample from a borehole, the method comprising:

taking the core sample within the borehole with a sampling tool;

generating a model of the core sample based on a plurality of input parameters, the generating including applying a value of each of the input parameters, wherein one or more of the input parameter values is associated with an uncertainty range;

defining a proposed tripping schedule, and performing, by a processor, an evaluation of the proposed tripping schedule, the evaluation including applying the proposed tripping schedule and a set of expected input parameter values to the model, estimating a core parameter and determining whether the tripping schedule is predicted to be successful by comparing the core parameter to selected core damage criteria;

iteratively repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a previous value of the at least one parameter in a previous evaluation, the value of the at least one parameter and the previous value of the at least one parameter selected from a range of parameter values within an uncertainty associated with the at least one parameter, each evaluation being performed using a different combination of input parameter values than any other evaluation;

calculating a probability of success (POS) of the proposed tripping schedule based on a number of evaluations that result in the tripping schedule being predicted to be successful, the POS having a value based on a proportion of a total number of evaluations that are being predicted to be successful; and removing the core sample through the borehole according to the proposed tripping schedule based on the calculated POS.

2. The method of claim 1, wherein repeating the evaluation includes iteratively performing the evaluation using a plurality of different sets of input parameter values, each different set of input parameter values having a value of at least one parameter that is adjusted relative to a previous evaluation within the uncertainty associated with the at least one parameter.

3. The method of claim 1, further comprising calculating a POS of a plurality of proposed tripping schedules.

4. The method of claim 3, further comprising generating a POS curve indicating the POS of each tripping schedule.

5. The method of claim 3, further comprising selecting one of the plurality of proposed tripping schedules, and removing the core sample according to the selected proposed tripping schedule.

6. The method of claim 1, wherein the model is a finite-element model of the core sample, and applying the proposed tripping schedule includes applying a boundary condition to the model at each increment of the proposed tripping schedule based on a depth of the core sample at each increment.

7. The method of claim 6, wherein the core parameter includes a differential pore pressure in the core sample based on external stress and pore pressure incident on the core sample at each increment.

8. The method of claim 7, wherein determining whether the tripping schedule is predicted to be successful includes comparing the differential pore pressure to a threshold pressure estimated based on tensile rock strength.

9. The method of claim 1, wherein the proposed tripping schedule prescribes an at least substantially constant tripping speed along a selected interval of the borehole.

10. A system for evaluating a schedule for removing a core sample from a borehole, the system comprising:

a carrier configured to transport the core sample through at least part of the borehole; and a processor configured to evaluate a tripping schedule for removing the core sample, the processor configured to perform:

generating a model of the core sample based on a plurality of input parameters, the generating including applying a value of each of the input parameters, wherein one or more of the input parameter values is associated with an uncertainty range;

defining a proposed tripping schedule, and performing an evaluation of the proposed tripping schedule, the evaluation including applying the proposed tripping schedule and a set of expected input parameter values to the model, estimating a core parameter and determining whether the tripping schedule is predicted to be successful by comparing the core parameter to selected core damage criteria;

repeating the evaluation by applying the proposed tripping schedule and a different set of input parameter values to the model, estimating the core parameter and determining whether the tripping schedule is predicted to be successful by comparing the core parameter to the selected core damage criteria, the different set of input parameter values including a value of at least one parameter that is different than a value of the at least one parameter in a previous evaluation, the value of the at least one parameter and the previous value of the at least one parameter selected from a range of parameter values within an uncertainty associated with the at least one parameter, each evaluation being performed using a different combination of input parameter values than any other evaluation;

calculating a probability of success (POS) of the proposed tripping schedule based on a number of evaluations that result in the tripping schedule being predicted to be successful, the POS having a value based on a proportion of a total number of evaluations that are being predicted to be successful; and controlling removal of the core sample through the borehole according to the proposed tripping schedule based on the calculated POS.

11. The system of claim 10, wherein repeating the evaluation includes iteratively performing the evaluation using a plurality of different sets of input parameter values, each different set of input parameter values having a value of at least one parameter that is adjusted relative to a previous evaluation within the uncertainty associated with the at least one parameter.

12. The system of claim 11, wherein the evaluation is repeatedly performing according to a Monte Carlo algorithm.

13. The system of claim 10, wherein the processor is configured to calculate a POS of a plurality of proposed tripping schedules.

14. The system of claim 13, wherein the processor is configured to generate a POS curve indicating the POS of each tripping schedule.

15. The system of claim 13, wherein the processor is configured to select one of the plurality of proposed tripping schedules, and control removal of the core sample according to the selected proposed tripping schedule.

16. The system of claim 10, wherein the model is a finite-element model of the core sample, and applying the proposed tripping schedule includes applying a boundary condition to the model at each increment of the proposed tripping schedule based on a depth of the core sample at each increment.

17. The system of claim 16, wherein the core parameter includes a differential pore pressure in the core sample based on external stress and pore pressure incident on the core sample at each increment.

18. The system of claim 17, wherein determining whether the tripping schedule is predicted to be successful includes comparing the differential pore pressure to a threshold pressure estimated based on tensile rock strength.

* * * * *